United States Patent [19]

Hechler, IV

[11] 4,306,688

[45] Dec. 22, 1981

[54] HOSE REEL ASSEMBLY

[75] Inventor: Valentine Hechler, IV, Northfield, Ill.

[73] Assignee: Injecto Mold, Inc., Chicago, Ill.

[21] Appl. No.: 109,222

[22] Filed: Jan. 3, 1980

Related U.S. Application Data

[63] Continuation of Ser. No. 14,061, Feb. 22, 1979, abandoned.

[51] Int. Cl.[3] ..... B65H 75/40

[52] U.S. Cl. ..... 242/86; 242/96

[58] Field of Search ..... 242/86, 86.1, 86.2, 242/86.3, 86.4, 96; 137/355.16, 355.17, 355.18, 355.19, 355.26

[56] References Cited

U.S. PATENT DOCUMENTS 3,225,974 12/1965 Athas ..... 242/86 X 3,970,264 7/1976 Fredriksson et al. ..... 242/96

4,022,398 5/1977 Youngblood ..... 242/86 X

FOREIGN PATENT DOCUMENTS 186981 11/1955 Fed. Rep. of Germany ..... 242/86

*Primary Examiner*—John M. Jillions

*Attorney, Agent, or Firm*—Alter and Weiss

[57] ABSTRACT

An improved hose reel assembly for use in storing and easily releasing a flat hose. The reel assembly comprises a base having a handle which facilitates unwinding the reel and which is also adapted for supporting the reel assembly in a hanging position. The reel assembly includes first and second nesting sockets for holding the nozzle coupling and the faucet coupling without exposure. A squeegie mechanism is included at the base for assuring that the stored hose is emptied of fluids thereby minimizing molding and rotting.

10 Claims, 6 Drawing Figures

HOSE REEL ASSEMBLY

This is a continuation application of application Ser. No. 14,061, filed Feb. 22, 1979 now abandoned.

This invention is concerned with hose reels; and more particularly, with hose reels designed to store normally flat hoses therein, such as hoses made out of woven material.

Prior art hose reels are available for storing flattened hoses thereon. The prior art hose reels; however, have many inadequacies. For example, in the prior art hose reels the nozzle coupling and the faucet coupling extended beyond the outer periphery of the hose reel assembly and therefore is exposed to possible damaging encounters.

Another problem with the prior art hose reels is that the handle was positioned in a manner most efficient for use by a right handed person. In addition, there was nothing to aid in removing excess water from the hose. Thus, the hose often did not lie flat, since it was not emptied of water; and accordingly, often became entangled or was not held properly by the reel.

Accordingly, an object of the present invention is to provide new and unique hose reels for use in storing hoses that adequately protect the coupling ends of the hoses.

A related object of the present invention is to provide hose reels for storing hoses thereon that encloses the entire hose including the couplings at the ends of the hoses but yet keeps the ends of the hoses available to the user of the hose.

Still another object of the present invention is to provide hose reels that automatically aids in emptying the hose of water prior to storage.

Yet another object of the present invention is to provide one-sided reels which include means for assuring that the hose is aligned by that one side.

A preferred embodiment of the present invention comprises a plastic hose reel assembly that includes a base unit having a single sided reel rotatably attached thereto. The base unit and the reel form a reel cavity surrounding the base when wound on the reel. The base unit includes a handle which removed from a nozzle coupling nesting cavity by substantially 180°. Radially removed from the nozzle coupling nesting cavity going towards the center of the base unit is an automatic squeegie arrangement which assures that excess water is removed from the hose as the hose is wound on the reel.

The reel includes a faucet coupling nesting socket which is characterized in a manner to enable maintaining the hose attached to the faucet while wound on the reel. On the base unit at the entrance to the reel cavity, a protrusion in the surface is provided which assures that the hose is forced towards the one side of the reel to aid in properly winding the hose on the reel, when the hose is in the flattened condition.

These and other objects and features of the present invention together with the manner of obtaining them will be best understood by making reference to the accompanying drawings, wherein.

Figure 1:
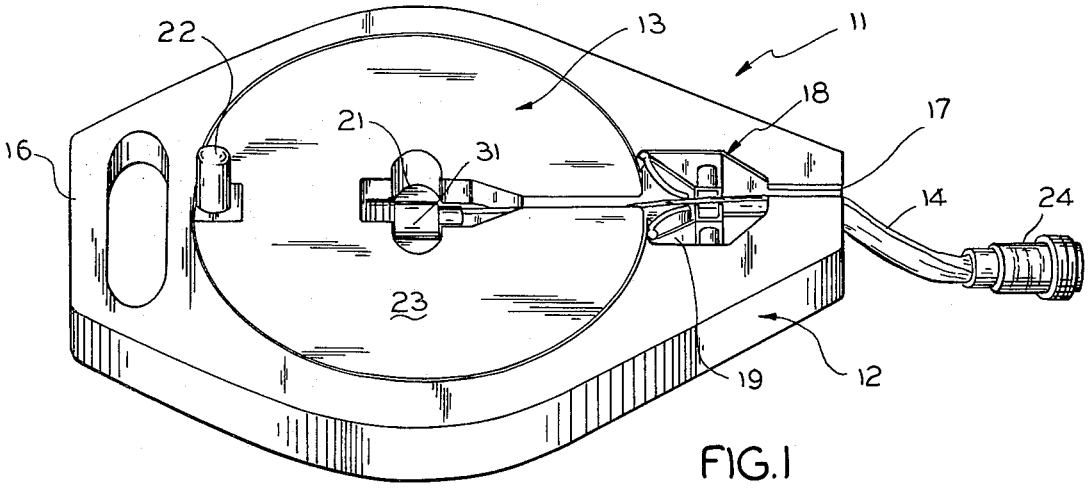
FIG. 1 is a pictorial view of the improved hose reel assembly.
Figure 2:
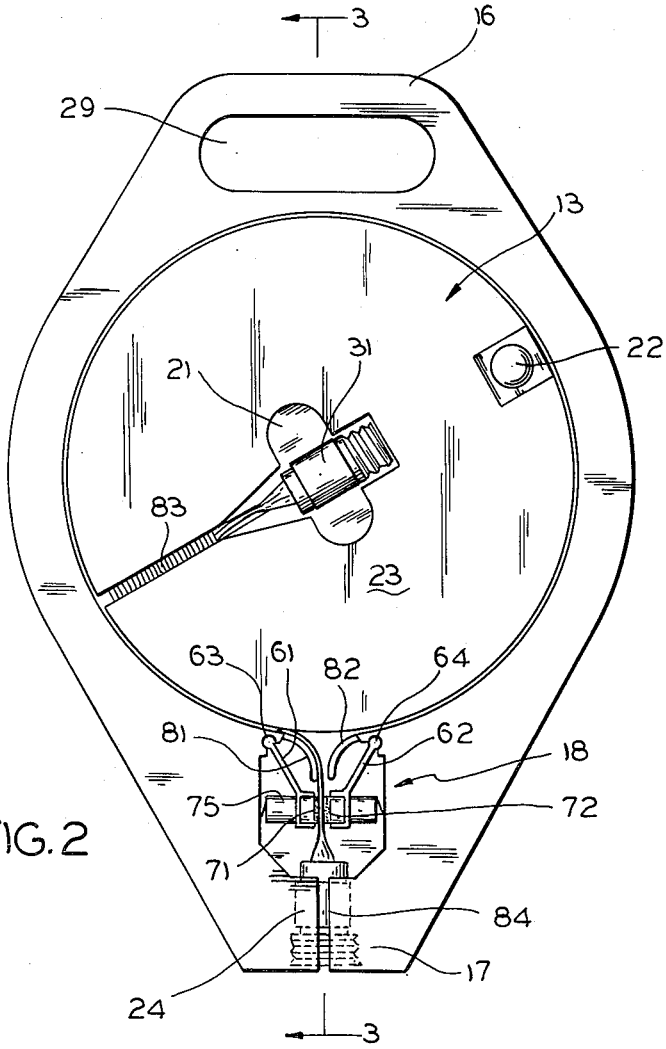
FIG. 2 is a plan view of the hose reel assembly of FIG. 1.

FIG. 1 shows an improved hose reel assembly 11 comprising base unit 12 containing a reel 13 rotatably mounted thereon. The reel is particularly used to store a normally flat hose 14. The base unit includes a handle 16 directly opposite a nozzle coupling nesting cavity 17.

The base unit also includes means for removing excess water from the hose as the hose is wound onto the reel. More particularly, a squeegie assembly 18 is provided in a cavity 19 shown adjacent to nesting cavity 17 and radially removed therefrom towards the axle of the reel 13.

The reel includes a faucet nozzle nesting cavity 21. Thus, when the hose is completely wound onto the reel no part of the hose or hose couplings extend outside of the periphery of the improved hose reel assembly.

Means are provided for conveniently rotating the reel. More particularly a reel handle 22 is provided at the periphery of the reel and extending normal to the reel plate 23. It should be noted that by providing the reel assembly handle 16 opposite the hose exit and entrance point at the socket 17, enables the user to hold the handle 16 with either the right hand or the left hand with equal facility.

Figure 3:
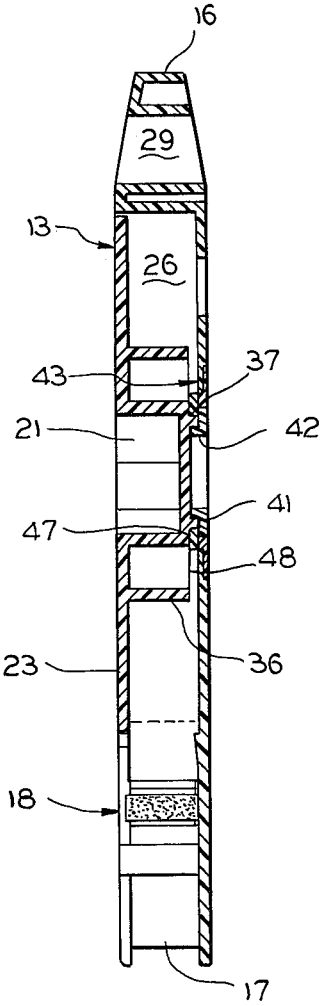
FIG. 3 is a sectional view of the hose reel assembly taken along line 3—3 in FIG. 2 and looking in the direction of the arrows.
Figure 4:
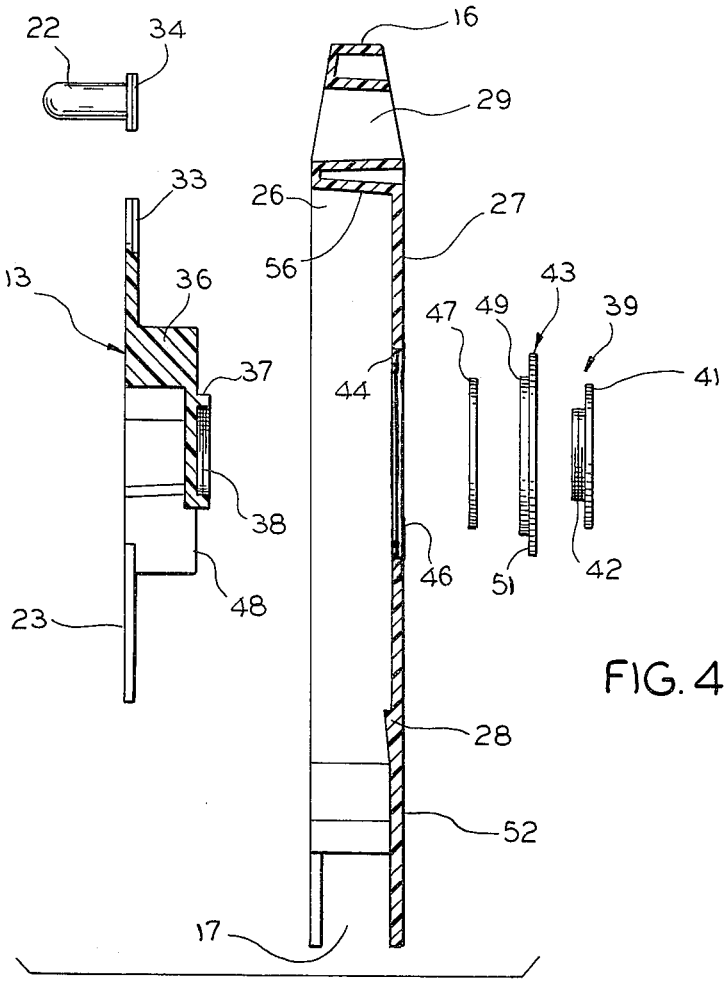
FIG. 4 is an exploded sectional view of the hose reel assembly particularly showing the rotatable mounting of the reel to the base unit.
Figure 5:
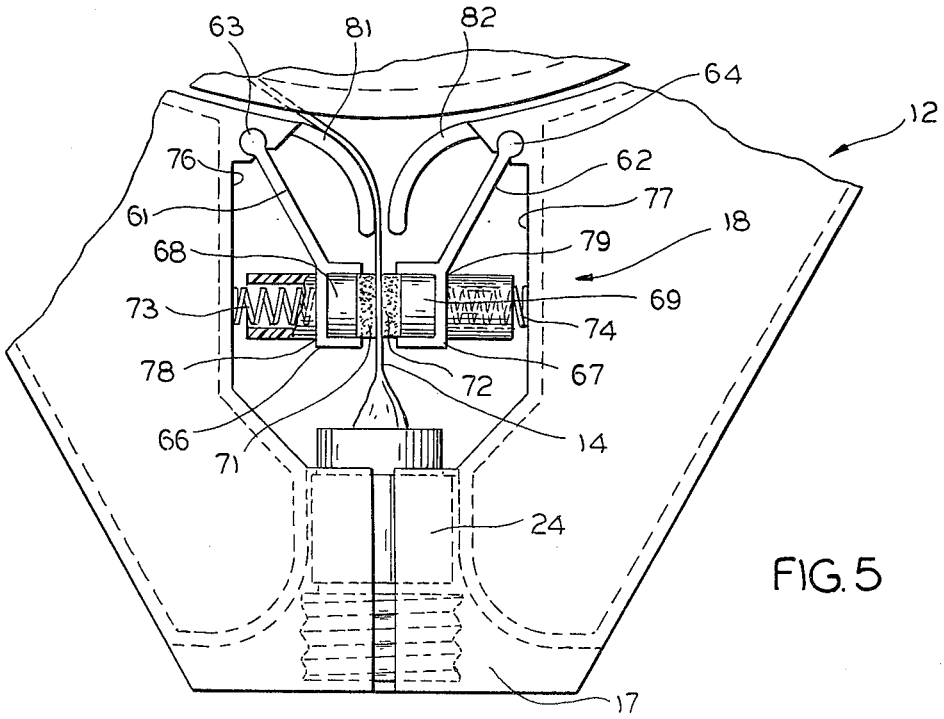
FIG. 5 show details of the squeegie section used in assuring that excess water is removed from the hose as the hose is wound onto the reel.

As can be seen best in FIGS. 3 and 4, for example, the base unit 12 has a height approximately equal to the height of the singled sided reel 13. A cavity 26 is provided in the base unit for receiving the reel therein. When the reel is in the base unit, the bottom or floor 27 of the cavity 26 acts as the other side of the reel. However, means are provided assuring that the flattened hose remains on the reel abutting the side 23 of the single sided reel. More particularly, this means is shown as the rise 28 on the floor 27 of the cavity.

This rise occurs at the point where the hose enters the cavity 26; i.e., the point radially aligned with the nesting socket 17.

The handle 16 is integral to the base unit 12 and is formed by the extended aperture 29 removed from the end of the base by the handle. The shape of the base is generally oval with truncated ends. The handle end is closer to the axle of the reel than is the coupling socket end. The sockets 17 and 21 protect and form nests for couplings 24 and 31, respectively. Coupling 24 is generally used for coupling a nozzle such as spraying device to the end of the hose. Coupling 31 is used for coupling the hose to a faucet or tap attached to the water source.

The reel handle 22 is attached to the reel 13 by any well known means, such as for example, molding tracks 33 onto reel 13 and having flanges for fitting underneath the tracks 34 on the handle 22. The reel comprises the side plate 23 and the hub section 36. The hub section terminates in an internally threaded shank 37. Internal threads are shown at 38. The threads receive threaded member 39. Member 39 includes a flange portion 41 and externally threaded neck portion 42. The neck portion 42 threads into threads 38. The neck portion 42 of member 39 is longer than the threaded portion 38 of shank 37 so that there is clearance between the flange 41 and the bearing washer 43.

It should be noted that the hub section 36 is held in cavity 44 of floor 27. Immediately below cavity 44 there is an aperture 46 axially aligned with cavity 44 and having a smaller diameter than cavity 44. Aperture 46 receives washer 47 which abuts the surface 48 of hub section 36. The shank portion 49 of bearing washer 43 also extends through aperture 46 to abut the washer 47. The larger diameter portion 51 of bearing washer 43 abuts the bottom surface 52 of floor 27. Flange section 41 of member 39 abuts section 51 of bearing washer 43, while the threaded shank portion 42 extends through the apertures on the units 43, 47 and through aperture 46 extending into the threaded section 38 of hub 36. Thus, the reel is rotatably mounted to the reel base.

The side 23 of the reel extends almost to the substantially vertical surface 56 of cavity 26. Thus, when the hose is wound on the reel, the hose is protected by the base, by the reel side 23 and by the sides 56, as well as by the floor 27. The mounted reel is shown best in FIG. 3.

Means are provided for assuring that the hose is clear of water, as it is wound up. More particularly, squeegie arrangement 18 is shown on the reel side of hose receiving slot 84. The squeegie 18 includes a pair of spring biased hose squeezing members. The squeezing members, each comprise arms 61 and 62 oppositely disposed immediately behind the nesting cavity 17. The arms 61 and 62 are pivotally attached at 63 and 64, respectively, to the base unit 12. The arms terminate in cup sections 66 and 67, respectively. The cup sections contain a relatively hard squeegie base 68 and 69, respectively. Attached to the squeegie bases 68 and 69 are the actual squeegies preferably made of nap material 71 and 72, respectively. The attachment of the nap material to the hoses can be by any well known methods, such as by gluing. It is not necessary that the material be napped, but it should be soft, resilient and pliable, to act to press all water out of interstices of the flattened hose 14.

Resilient members, such as springs 73 and 74 are mounted between the cavity sides 76 and 77 and the outside bottoms 78 and 79 of cups 66 and 67, respectively.

Means are provided for guiding the hose onto the reel. More particularly, the plastic members 81 and 82 are provided which act to guide the hose into the reel.

Figure 6:
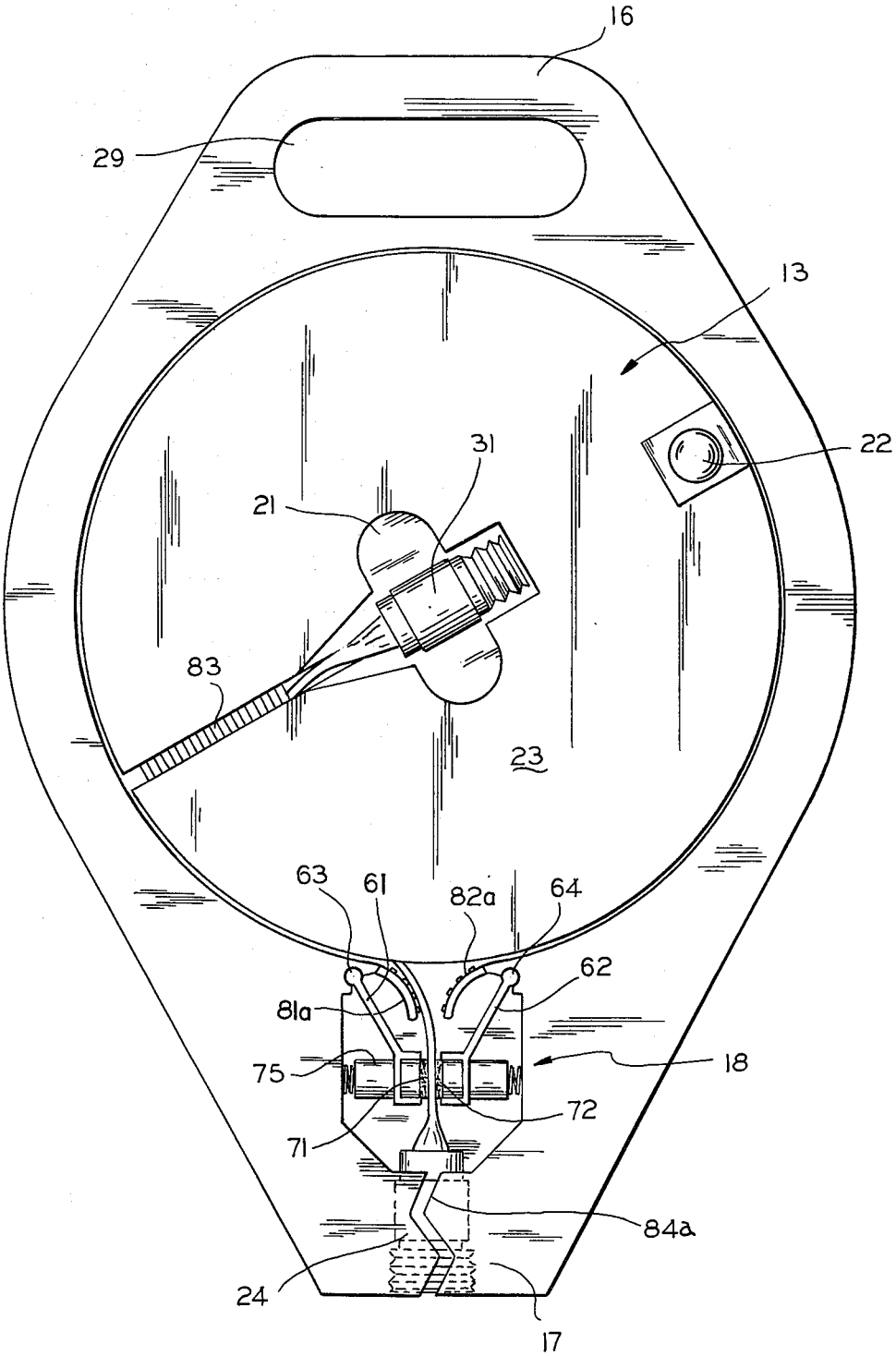
FIG. 6 shows a plan view of another embodiment of the hose reel assembly of FIG. 1.

In the embodiment shown in FIG. 6 the slot 84*a* assumes a zig-zag shape which aids in keeping the hose from falling out of the slot in the rewinding process. Further, the guiding means 81*a* and 82 are knurled to aid in straightening the hose on the reel.

In operation, then, the improved hose reel is normally hung on a hook arrangement, not shown, by its handle 16. The coupling 31 can normally be left attached to a tap or faucet. To use the hose, the reel is removed from the hook. The user then holds the reel by the handle 16, while pulling the hose, starting at coupling 17, to cause reel 13 to unwind. When the hose is completely unwound, the tap is turned on and the hose is used. To rewind the hose on a reel, the hose near the coupling 31 end of the hose is put through the slot 83. Coupling 31 is pressed into nesting cavity 21 and the hose is threaded through slot 84, guides 81 and 82 and also forced between squeegie sections 71 and 72, and into slot 84. Handle 22 is then operated to turn reel 13, winding the hose onto the reel, while pulling the hose through the squeegie unit 18. This is done until coupling 24 is nesting in cavity 17. The reel assembly is held by handle 16 and the reel handle 22 is operated to wind the hose onto the reel.

While the principles of the invention have been described above in connection with specific apparatus and applications it is to be understood that this description is made by way of example only and not as a limitation on the scope of the invention.

What is claimed is:

1. An improved hose reel assembly for use in storing flat hoses;

said reel assembly comprising a base unit, said base unit including handle means at one side thereof, nozzle coupling socket means in said base unit positioned at a side opposite to said handle means, slot means at said nozzle coupling socket means to enable loading of the hoses into said reel assembly, reel means for winding said hose, and means for rotatably mounting said reel means to said base unit.

2. The improved hose reel assembly of claim 1 wherein said reel means comprising a single sided reel.

3. The improved hose reel assembly of claim 2 wherein said base unit comprises a reel cavity for receiving said reel means, said reel cavity including a cavity floor having approximately the dimensions of the reel and defined by the cavity walls extending upwardly from said floor, and said reel means having a reel handle thereon affixed and normal to said single side and extending outwardly therefrom for use in rotating said reel to wind said hose thereon.

4. The improved hose reel assembly of claim 3 wherein said reel means comprises a hub section, said single side of said reel means spaced apart from the cavity floor by said hub section, said hub section shaped to receive said hose thereon, and second hose coupling socket means in said single side.

5. The improved hose reel assembly of claim 4 wherein abutting means are provided for assuring that the hose abuts the single side of the reel when wound on the reel.

6. The improved hose reel assembly of claim 5 wherein said abutting means comprises a rise on the floor of said cavity for forcing the hose against said single side.

7. The improved hose reel assembly of claim 6 wherein said hub section includes means for rotatably attaching said reel to said base unit, and wherein said rise is located when the hose enters said cavity radially removed from said first hose coupling socket means toward the center of said reel means.

8. An improved hose reel assembly for use in storing flat hoses, said reel comprising a base unit, said base unit including handle means at one side thereof, nozzle coupling socket means in said base unit positioned at a side opposite to said handle means, reel means for winding said hose, means for rotatably mounting said reel means to said base unit, squeegie means for forcing excess liquid from said hose as said hose is wound on said reel, said squeegie means comprising a pair of oppositely disposed squeegie elements, said elements biased against each other by spring means, and arm means pivotally affixing each of said squeegie elements to said base unit to squeeze said flattened hose on both sides as said hose is wound on said reel.

9. An improved hose reel assembly for use in storing a flat hose, said reel assembly comprising a base unit, said base unit including handle means peripherally disposed at one side thereof, nozzle coupling socket means in said base unit, zig-zag shaped slot means at said nozzle coupling to enable loading of the hoses onto said reel assembly, reel means for winding said hose, and means for rotatably mounting said reel means to said base unit.

10. The improved hose reel of claim 9 including squeegie means having opposing squeezing parts for squeezing said flattened hose on both sides, while it is being wound on said reel, guide elements extending from said squeegie means to said reel means, and said guide elements being arcuately shaped and having knurled surface means to aid in straightening the hose as it is wound on the reel.

* * * * *

UNITED STATES PATENT AND TRADEMARK OFFICE

CERTIFICATE OF CORRECTION

PATENT NO. : 4306688

DATED : December 22, 1981

INVENTOR(S) : Valentine Hechler, IV

It is certified that error appears in the above-identified patent and that said Letters Patent are hereby corrected as shown below:

Column 3, line 50, "82" should read -- 82a --.

Signed and Sealed this

*Seventh* Day of *September 1982*

[SEAL]

*Attest:*

GERALD J. MOSSINGHOFF

*Attesting Officer* *Commissioner of Patents and Trademarks*